US006672494B1

(12) United States Patent
Fernandez

(10) Patent No.: US 6,672,494 B1
(45) Date of Patent: Jan. 6, 2004

(54) SHOULDER-STRAPPED LADDER

(76) Inventor: Jesus Fernandez, 17701 S. Avalon Blvd. #324, Carson, CA (US) 90746

( * ) Notice: Subject to any disclaimer, the term of this patent is extended or adjusted under 35 U.S.C. 154(b) by 0 days.

(21) Appl. No.: 10/120,094

(22) Filed: Apr. 11, 2002

(51) Int. Cl.[7] ..... E04G 1/00; E04G 3/00

(52) U.S. Cl. ..... 224/576; 182/129; 224/257; 224/268

(58) Field of Search ..... 224/255, 257, 224/258, 264, 268, 576; 182/129; 294/158, 165

(56) References Cited

U.S. PATENT DOCUMENTS 4,470,528 A * 9/1984 Dyess ..... 224/257
5,203,482 A * 4/1993 Puff ..... 224/264
5,242,030 A * 9/1993 Lobozzo ..... 182/129
5,433,288 A * 7/1995 James ..... 224/250
5,511,285 A * 4/1996 Bush et al. ..... 182/129
6,193,012 B1 * 2/2001 Olivas ..... 224/257
2002/0005125 A1 * 1/2002 Caputi ..... 224/264

* cited by examiner

*Primary Examiner*—Gary E. Elkins

(57) ABSTRACT

A shoulder-strapped ladder for allowing a ladder to be easily carried from a user's shoulder with the ladder being held together. The shoulder-strapped ladder includes a ladder having rails and a plurality of rungs interconnecting the rails; and also includes a shoulder strap assembly including an adjustable shoulder strap being detachably attached to the ladder to allow a user to carry the ladder from one's shoulder; and further includes a bounder strap assembly including a bounder strap being fastenable about the rails for binding the rails together; and also includes an assembly for attaching the shoulder strap assembly to the ladder.

3 Claims, 4 Drawing Sheets

SHOULDER-STRAPPED LADDER

BACKGROUND OF THE INVENTION

1. Field of the Invention

The present invention relates to shoulder-carried ladders and more particularly pertains to a new shoulder-strapped ladder for allowing a shoulder-strapped ladder to be easily carried from a user's shoulder with the shoulder-strapped ladder being held together.

2. Description of the Prior Art

The use of shoulder-carried ladders is known in the prior art. More specifically, shoulder-carried ladders heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 6,193,012; U.S. Pat. No. 5,511,285; U.S. Pat. No. 2,394,805; U.S. Pat. No. 4,558,807; U.S. Pat. No. 5,813,530; U.S. Pat. No. 5,242,030; and U.S. Pat. No. Des. 429,386.

While these devices fulfill their respective, particular objectives and requirements, the aforementioned patents do not disclose a new shoulder-strapped ladder. The prior art includes inventions having shoulder straps attached to ladders.

SUMMARY OF THE INVENTION

The general purpose of the present invention, which will be described subsequently in greater detail, is to provide a new shoulder-strapped ladder which has many of the advantages of the shoulder-carried ladders mentioned heretofore and many novel features that result in a new shoulder-strapped ladder which is not anticipated, rendered obvious, suggested, or even implied by any of the prior art shoulder-carried ladders, either alone or in any combination thereof. The present invention includes a shoulder-strapped ladder having rails and a plurality of rungs interconnecting the rails; and also includes a shoulder strap assembly including an adjustable shoulder strap being detachably attached to the ladder to allow a user to carry the ladder from one's shoulder; and further includes a bounder strap assembly including a bounder strap being fastenable about the rails for binding the rails together; and also includes an assembly for attaching the shoulder strap assembly to the ladder. None of the prior art includes bounder straps for binding the rails together to make it easier for the user to carry the ladder.

There has thus been outlined, rather broadly, the more important features of the shoulder-strapped ladder in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new shoulder-strapped ladder which has many of the advantages of the shoulder-carried ladders mentioned heretofore and many novel features that result in a new shoulder-strapped ladder which is not anticipated, rendered obvious, suggested, or even implied by any of the prior art shoulder-carried ladders, either alone or in any combination thereof.

Still another object of the present invention is to provide a new shoulder-strapped ladder for allowing a ladder to be easily carried from a user's shoulder with the ladder being held together.

Still yet another object of the present invention is to provide a new shoulder-strapped ladder that is easy and convenient to use.

Even still another object of the present invention is to provide a new shoulder-strapped ladder that keeps the rails from coming apart thus making it easier to carry the shoulder-strapped ladder from place to place.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
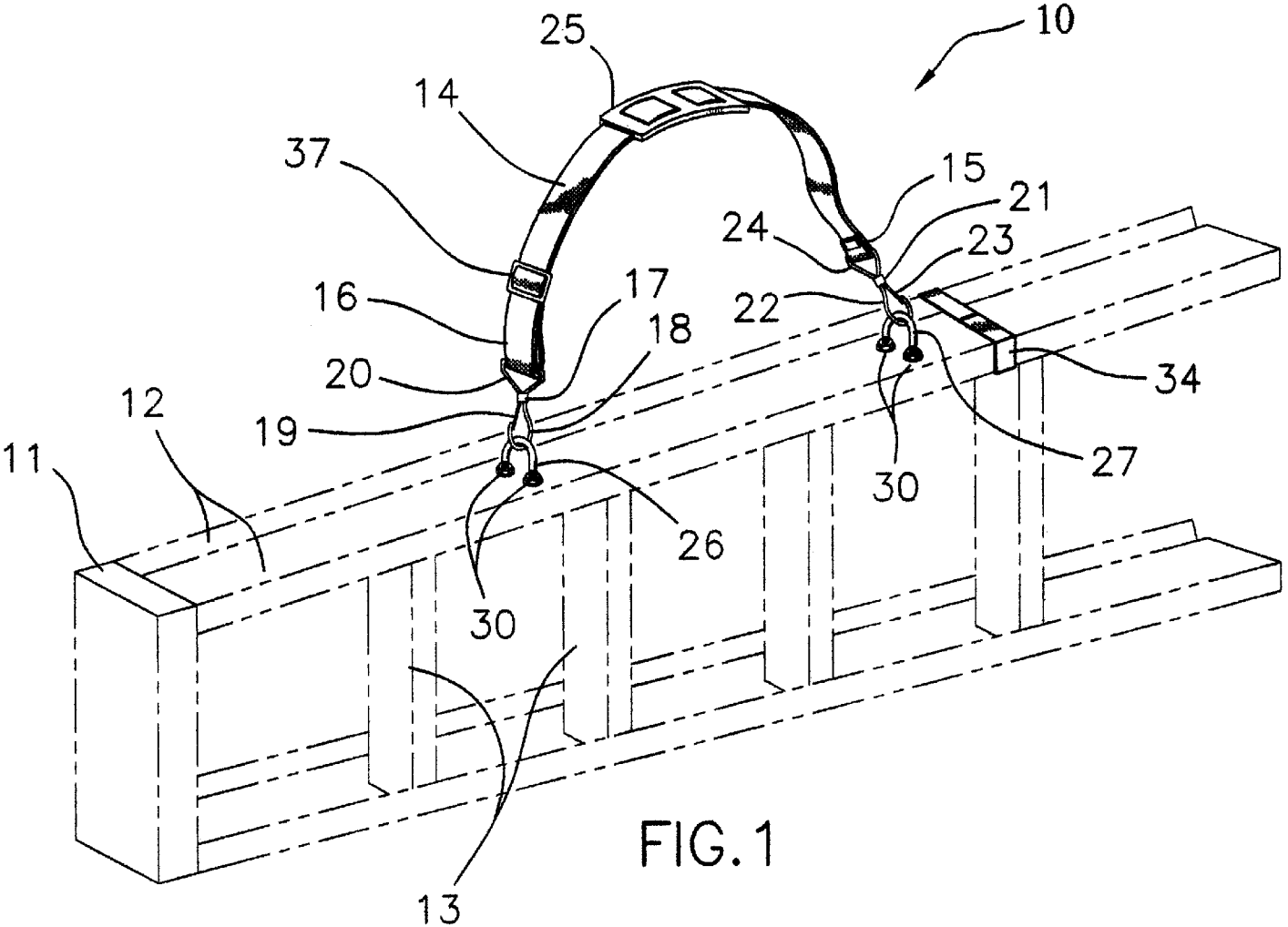
FIG. 1 is a perspective view of a new shoulder-strapped ladder according to the present invention.
Figure 2:
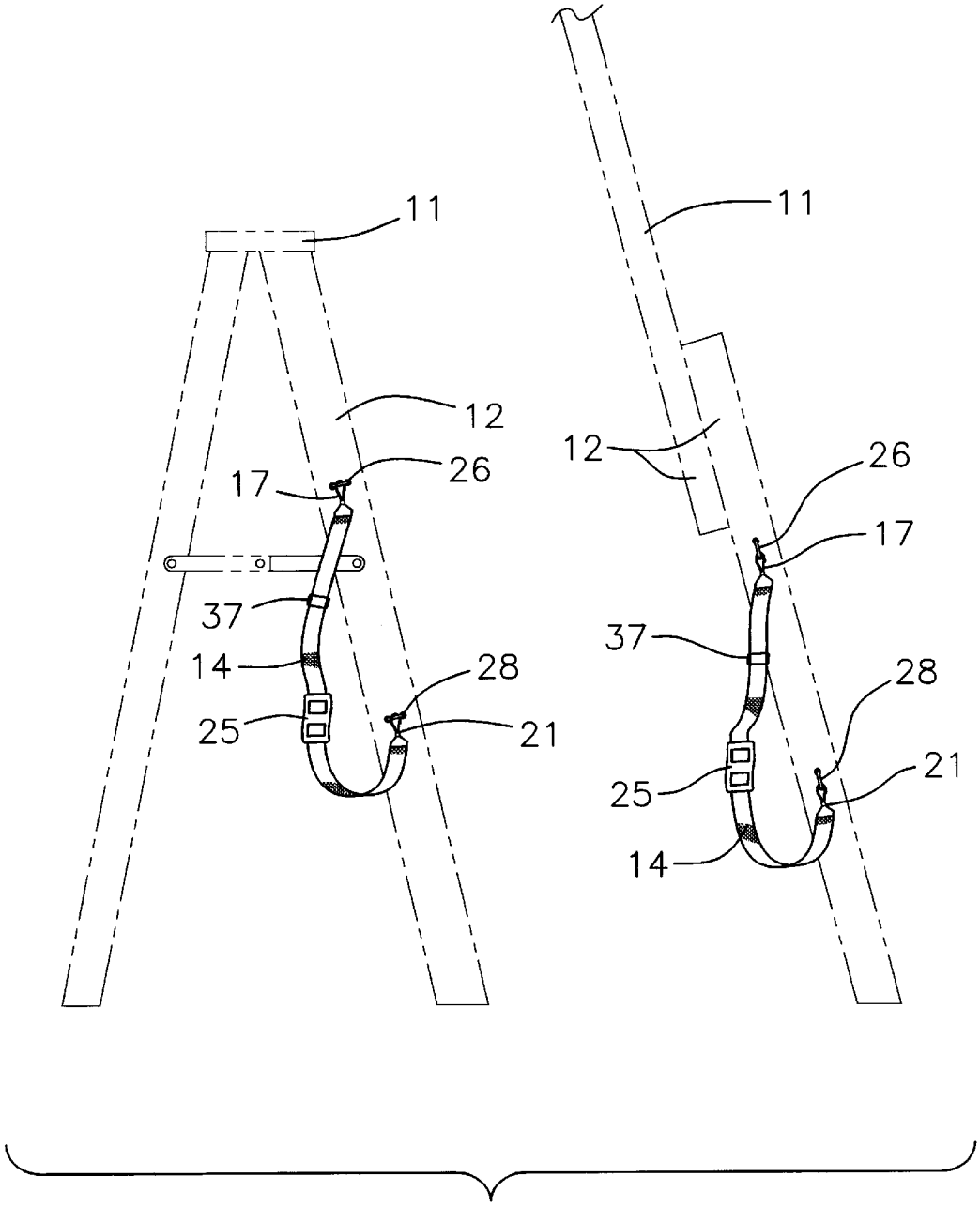
FIG. 2 is a side elevational views of the present invention.
Figure 3:
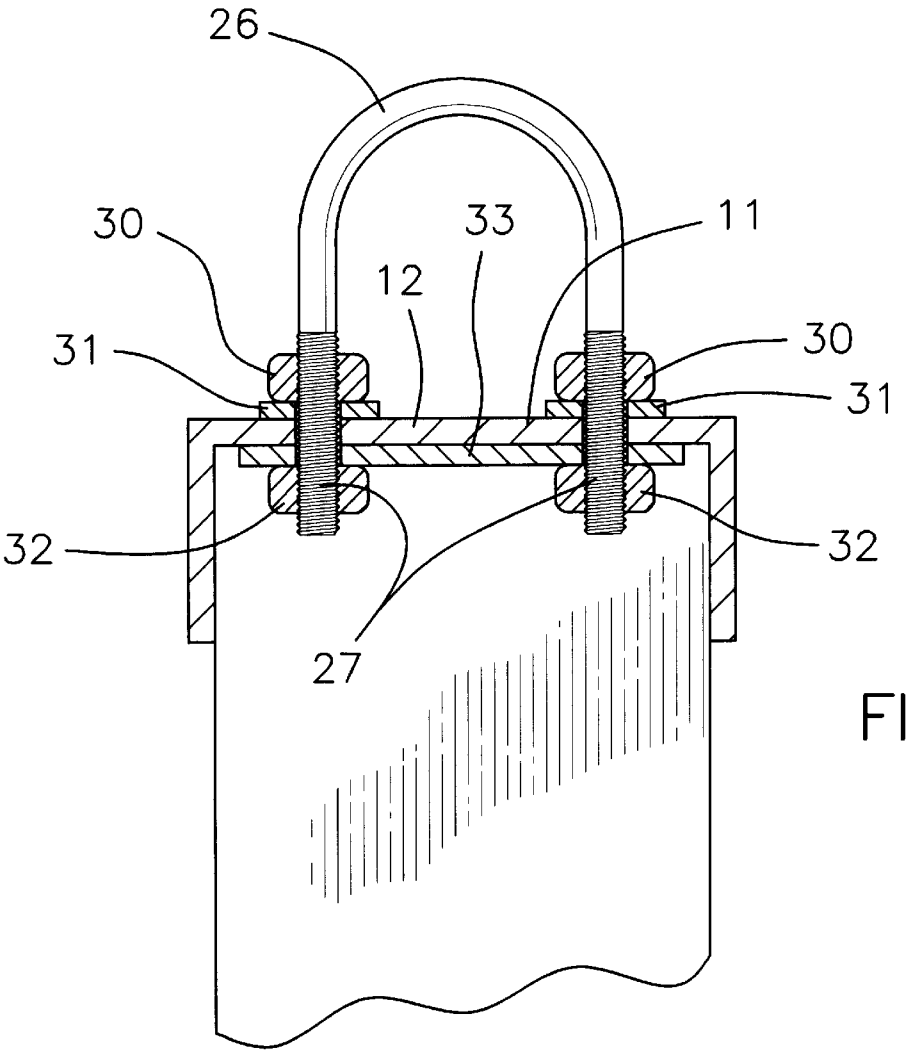
FIG. 3 is a cross-sectional view of one of the fasteners of the present invention.
Figure 4:
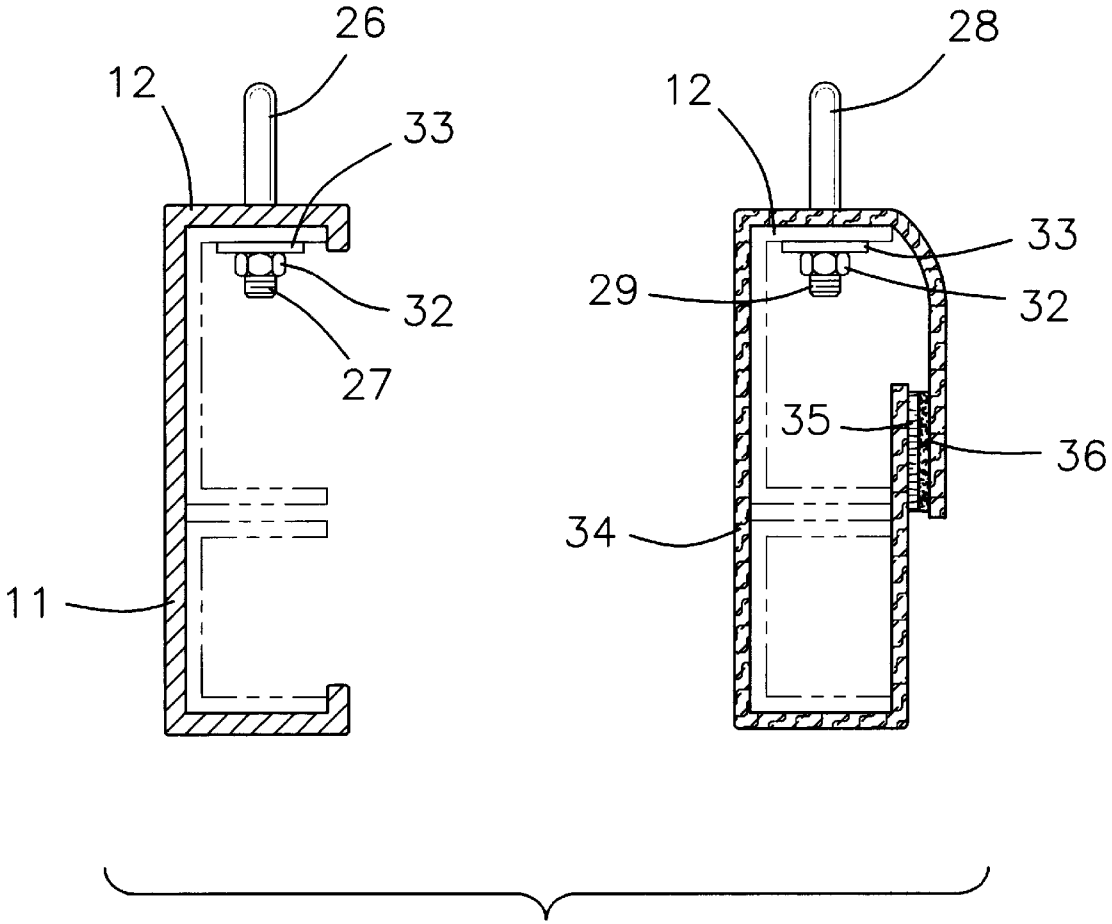
FIG. 4 is a side elevational view of the present invention.

With reference now to the drawings, and in particular to FIGS. 1 through 4 thereof, a new shoulder-strapped ladder embodying the principles and concepts of the present invention and generally designated by the reference numeral 10 will be described.

As best illustrated in FIGS. 1 through 4, the shoulder-strapped ladder 10 generally comprises a ladder 11 having rails 12 and a plurality of rungs 13 conventionally interconnecting the rails 12. A shoulder strap assembly includes an adjustable shoulder strap 14 being detachably and conventionally attached to the ladder 11 to allow a user to carry the ladder 11 from one's shoulder. The shoulder strap assembly further includes clip members 17,21 each having a hook portion 18,22 and a latch 19,23 for closing the hook portion 18,22, and also having a ring portion 20,24. The adjustable shoulder strap 14 has a first looped end 15 which is looped about the ring portion 24 of one of the clip members 21, and also has a second end portion 16 which is looped about the ring portion 20 of another of the clip members 17. The shoulder strap assembly also includes a buckle 37 being slidably adjusted about the adjustable shoulder strap 14 and through which the second end portion 16 of the adjustable shoulder strap 14 is strung, and further includes a shoulder pad member 25 being slidably adjusted about the adjustable shoulder strap 14.

A means for attaching the shoulder strap assembly to the ladder 11 includes U-shaped bolts 26,28 being conventionally disposed through holes in one of the rails 12 of the ladder 11, and also includes threaded first fasteners 30 being threaded on end portions 27,29 of the U-shaped bolts 26,28, and further includes washers 31 being disposed about the end portions 27,29 of the U-shaped bolts 26,28 and being engaged between the threaded first fasteners 30 and the ladder 11, and also includes spacer plates 33 through which the U-shaped bolts 26,28 are extended, and further includes threaded second fasteners 32 being threaded on the end portions 27,29 of the U-shaped bolts 26,28 and being engaged to the spacer plates 33 for securely attaching the U-shaped bolts 26,28 to the ladder 11.

A bounder strap assembly includes a bounder strap 34 being fastenable about the rails 12 for binding the rails 12 together. The bounder strap 34 has an end portion through which one of the U-shaped bolts 28 is extended to securely hold the bounder strap 34 to the ladder 11 with the bounder strap 34 being extendable about pairs of the rails 12 for bounding the pairs of the rails 12 together during transporting of the ladder 11. The bounder strap assembly further includes strips of hook and loop fasteners 35,36 being securely and conventionally attached at ends of the bounder strap 34 for fastening the ends of the bounder strap 34 together about the pairs of the rails 12.

In use, the user would fasten the rails 12 together using the bounder strap 34 so that the rails 12 cannot come apart during the transporting of the ladder 11, and the user would sling the adjustable shoulder strap 14 about one's shoulder to carry the ladder 11. Once the ladder is transported, the user undoes the bounder strap 34 to allow the rails 12 to spread apart for using the ladder 11.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the ladder. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A shoulder-strapped ladder comprising:

a ladder having rails and a plurality of rungs interconnecting said rails;

a shoulder strap assembly including an adjustable shoulder strap being detachably attached to said ladder to allow a user to carry the ladder from one's shoulder, said shoulder strap assembly further including clip members each having a hook portion and a latch for closing said hook portion and each also having a ring portion;

a bounder strap assembly including a bounder strap being fastenable about said rails for binding said rails together; and a means for attaching said shoulder strap assembly to said ladder including U-shaped bolts being disposed through holes in one of said rails of said ladder, and also including threaded first fasteners being threaded on end portions of said U-shaped bolts, and further including washers being disposed about said end portions of said U-shaped bolts and being engaged between said threaded first fasteners and said ladder, and also including spacer plates through which said U-shaped bolts are extended, and further including threaded second fasteners being threaded on said end portion of said U-shaped bolts and being engaged to said spacer plates for securely attaching said U-shaped bolts to said ladder.

2. A shoulder-strapped ladder as described in claim 1, wherein said bounder strap has an end portion through which one of said U-shaped bolts is extended to securely hold said bounder strap to said ladder, said bounder strap being extendable about pairs of said rails for bounding said pairs of said rails together during transporting of said ladder.

3. A shoulder-strapped ladder as described in claim 2, wherein said bounder strap assembly further includes strips of hook and loop fasteners being securely attached at ends of said bounder strap for fastening said ends of said bounder strap together about said pairs of said rails.

* * * * *